US005197259A

United States Patent [19]

Menayan

[11] Patent Number: 5,197,259

[45] Date of Patent: Mar. 30, 1993

[54] CONVEYOR SYSTEM AND MACHINE FOR APPLYING TAMPER-EVIDENT BANDS TO CONTAINERS

[76] Inventor: Victor V. Menayan, 103 Rothschild Pl., Cary, N.C. 27511

[21] Appl. No.: 830,186

[22] Filed: Jan. 31, 1992

[51] Int. Cl.[5] ..... B65B 53/02

[52] U.S. Cl. ..... 53/399; 53/585; 53/291; 198/803.14

[58] Field of Search ..... 198/345.1, 735.3, 803.13, 198/803.14, 803.15; 53/176, 291, 292, 293, 296, 399, 585; 156/558, DIG. 14, DIG. 15, DIG. 17, DIG. 25

[56] References Cited

U.S. PATENT DOCUMENTS

| | | | |
|---|---|---|---|
| 2,952,352 | 9/1960 | Hoffman | 198/803.14 X |
| 3,004,651 | 10/1961 | Manspeaker et al. | 198/803.14 X |
| 3,890,767 | 6/1975 | Cawrse | 53/296 |
| 3,924,387 | 12/1975 | Konstantin | 53/291 |
| 3,965,656 | 6/1976 | Gerben | 53/296 X |
| 4,562,688 | 1/1986 | Mueller | 53/292 X |
| 4,691,835 | 9/1987 | Mueller | 53/296 X |
| 4,765,121 | 8/1988 | Konstantin et al. | 53/567 X |
| 4,778,045 | 10/1988 | Grune et al. | 198/803.14 X |
| 4,914,893 | 4/1990 | Strub et al. | 53/292 X |
| 5,070,680 | 12/1991 | Nagano | 53/292 X |

*Primary Examiner*—John Sipos
*Assistant Examiner*—Daniel Moon
*Attorney, Agent, or Firm*—Rhodes, Coats & Bennett; Rhodes, Coats and Bennett

[57] ABSTRACT

The present invention entails a conveyor system for use in conjunction with a band application machine that applies tamper-evident bands to containers being conveyed by the conveyor system. The conveyor includes a conveyor with an upper run and a lower run. Connected to the conveyor and moving with the conveyor is a series of band support plates that each define an individual container opening. A container support plate extends beneath the conveyor's upper run and below the band support plates being conveyed along the conveyor's upper run. Each container is inserted into an individual container opening such that the container is vertically supported by the container support plate and such that the band support plate extends around the container. The band support plates are positionable at a selected vertical position about the containers by varying the relative height of the container support plate beneath the band support plates. The inserted containers are slid along the container support plate by the band support plates toward the band application machine. The band application machine places tamper-evident bands about the top of containers and the tamper-evident bands are supported by the band support plates at a selected vertical position on the container. The band support plates encircle the containers and provide continuous support for the tamper-evident bands placed about the container. While the bands are supported by the band support plates at a selected position about the containers, the bands are spot-heated or heat shrunken to fix the tamper-evident bands about the containers.

17 Claims, 7 Drawing Sheets

CONVEYOR SYSTEM AND MACHINE FOR APPLYING TAMPER-EVIDENT BANDS TO CONTAINERS

FIELD OF THE INVENTION

The present invention relates generally to conveyors and band application machines for applying tamper-evident bands to containers, and more particularly, to a system for supporting a tamper-evident band at a selected height about a container.

BACKGROUND OF THE INVENTION

Tamper-evident bands are often placed on containers to prevent undetected tampering with the containerized product. Tamper-evident bands ordinarily encircle a container about the bottom edge of the container cover. Placement of the tamper-evident band in this location prevents undetected removal of the cover from the container. Containerized products typically requiring the application of tamper-evident bands include numerous products such as food and drugs, and these products may be held in containers of various sizes and shapes.

Automated systems have been used in the prior art to apply tamper-evident bands to containerized products. These prior art systems normally include a conveyor system that conveys containers to a band application machine that places a continuous circular band about each container. While the tamper-evident band is about the container, the tamper-evident band is spot-heated so that the tamper-evident band adheres to the container and remains in place without additional support.

Prior to spot heating the tamper-evident band, the band must be supported by a supporting mechanism at the proper location on the container. The varied sizes and shapes of containers requiring the application of tamper-evident bands make it difficult for band application systems to support tamper-evident bands at the proper location on containers. Some containers have shoulders on which bands are supported prior to spot heating the bands to the containers. Other prior art systems employ band support plates positioned to provide support to the band at opposite sides of the container. Lack of proper support of the bands while the bands are being fixed to the containers will result in misalignment of the bands about the containers. Misalignment of a tamper-evident band may result in a product that cannot be sold.

SUMMARY AND OBJECTS OF THE INVENTION

The present invention is a conveyor system used in conjunction with a band application machine that applies tamper-evident bands to containers being conveyed by the conveyor system. The conveyor system of the present invention provides for more effective application of bands to containers through the use of an improved conveyor system and band application machine.

During the application of a tamper-evident band to a container, the conveyor system provides a container beneath the band application machine. A band is then placed about the container and spot-heated to fix the band into position about the container. During spot-heating, the band must be supported in the desired position about the container to prevent misalignment of the band being applied to the container.

The conveyor system of the present invention ensures proper positioning of the band during spot-heating of the band to the container through the use of a specially designed conveyor system. The conveyor system has a series of band support plates connected to an endless conveyor chain that has an upper and lower run. Each band support plate encircles an individual container opening that can accomodate an individual container. Containers can be vertically positioned within the container openings such that a selected portion of the container extends above the band support encircling the container. The containers located within the band support plates and conveyed by the conveyor system are vertically supported within the container openings by a container support plate that extends beneath the upper run of the conveyor. By selectively choosing the distance at which the container support plate is located below the conveyor's upper run, the portion of the container extending above the band support plate can be controlled.

The present invention conveyor system conveys containers and accurately places bands on containers as follows. First, a container at an upstream position of the conveyor is inserted into a container opening such that a band support plate encircles the container and the container bottom rests on the container support plate. The band support moves with the conveyor causing the container within the band support plate to be slid along the container support plate and moved toward the band application machine. As the container is conveyed downstream, the container support plate slopes downwardly causing the container to be positioned downwardly in the container opening and the band support plate to be positioned at a selected position about the container. As the container passes beneath the band application machine, a band suspended from the band application machine is transferred to the container and supported at a selected position about the container top by the band support plate. The band is then spot-heated to fix the band about the container.

Because the band support plate encircles the container, the band placed about the container is provided with continuous, uniform support which ensures proper positioning of the band during spot heating. Proper positioning of the band when spot heating the band to the container is essential to proper alignment and placement of the band about the container. The continuous, uniform support that the band support provides to bands placed about containers is particularly important in the proper positioning of tamper-evident bands about large containers. Tamper-evident bands placed about large containers tend to droop or become misaligned when being spot-heated to a container. Likewise, the continuous, uniform support provided by the band support plates of the present invention is particularly important for the application of tamper-evident bands having a narrow thickness. Bands having narrow thicknesses also tend to droop and become misaligned when being spot-heated, and thus, require the additional support provided by the present invention band support plates.

Once the tamper-evident band is spot-heated about the container, the container is conveyed downstream on the conveyor. As the container is conveyed away from the band application machine, the container support plate slopes upwardly causing the container to be ejected upward through the band support plate. After being ejected upward through the band support plate, the container is removed from the conveyor system.

It is therefore an object of the present invention to provide a conveyor system and band application machine for accurately applying tamper-evident bands to containers.

Another object of the present invention conveyor system and band application machine is to efficiently apply tamper-evident bands to a series of containers being conveyed on a conveyor.

Another object of the present invention conveyor system and band application machine is to provide a system that can accurately apply tamper-evident bands to various sized containers and, in particular, large containers.

Another object of the present invention conveyor system and band application machine is to provide a system that can accurately apply to containers tamper-evident bands having relatively narrow widths.

Another object of the present invention conveyor system and band application machine is to provide a system for accurately positioning tamper-evident bands at selected positions about containers.

It is an object of the present invention to provide a conveyor system for a band application machine that will support a band at a multiplicity of points substantially entirely around the container.

Another object of the present invention is to provide a rigid band support plate that substantially encircles the container and defines a container opening therein for encircling the container.

Another object of the present invention is to provide means for automatically inserting and removing containers from the container opening and the rigid band support plates.

Another object of the present invention conveyor system and band application machine is to provide a system that is reliable and consistently applies tamper-evident bands at the proper location about containers.

Other objects and advantages of the present invention will become apparent and obvious from a study of the following description and the accompanying drawings which are merely illustrative of such invention.

DETAILED DESCRIPTION OF THE INVENTION

Figure 1:
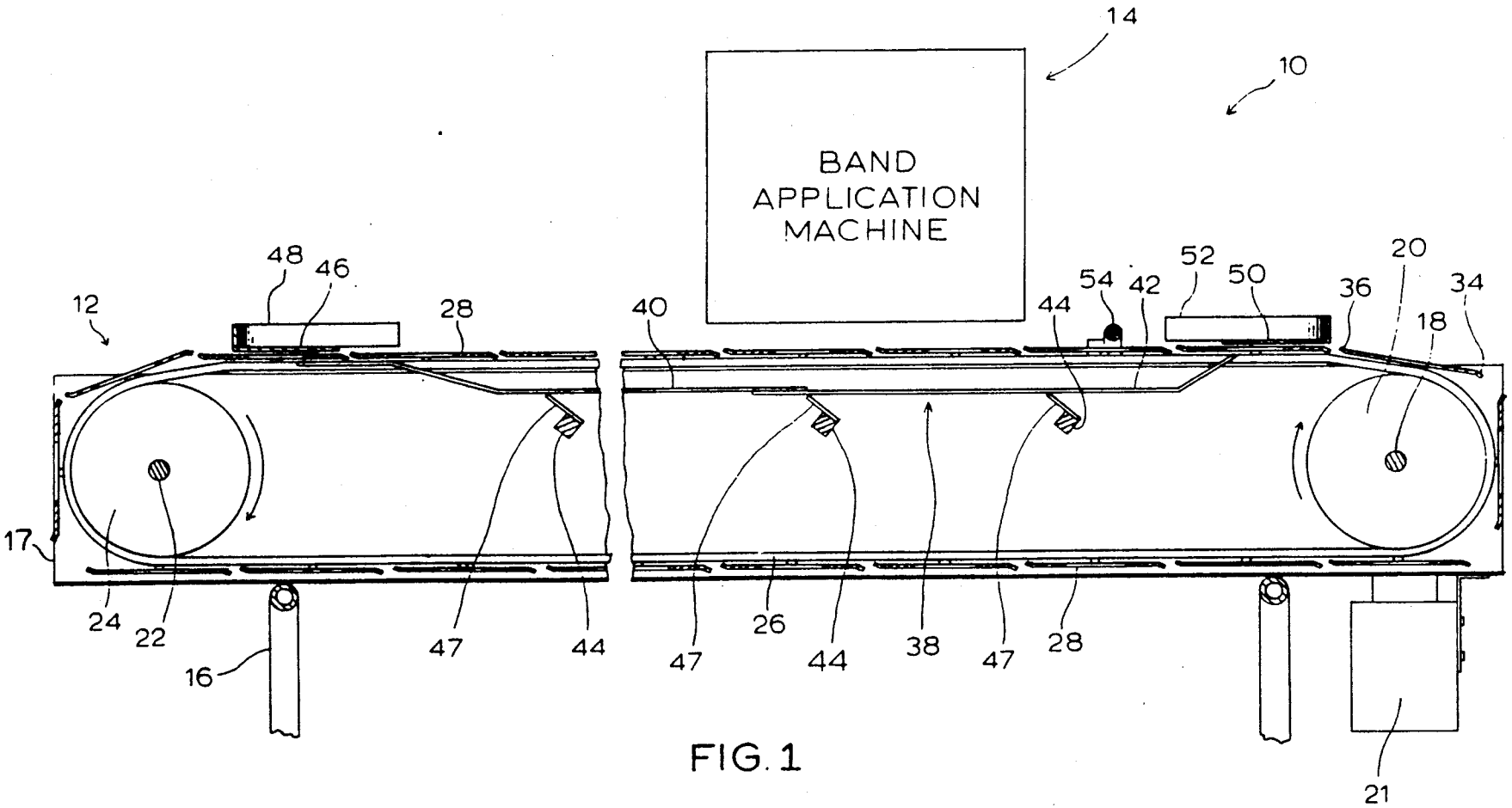
FIG. 1 is a side elevational view of the present invention with portions of the frame structure removed to better illustrate the invention.

With further reference to the drawings, the band conveyor and application system of the present invention is shown therein and indicated generally by the number 10. Conveyor and band application system 10 includes a conveyor assembly indicated generally by the numeral 12 and a band application unit indicated generally by the numeral 14.

For a complete understanding of the conveyor assembly 12, a brief description of the basic operation of the band application unit 14 is set forth. Details of the band application unit 14 are not dealt with herein because such is not per se material to the present invention and because such band application units are commercially available today and their structure and function are well-known to those skilled in the art. For a more complete description of band application units, reference can be made to the disclosures found in U.S. Pat. Nos. 4,914,893; 4,562,688; 4,649,697; and the disclosure found in my presently pending application entitled Machine For Applying Tamper Evident Bands To Containers, U.S. patent application Ser. No. 07/754,976, filed Sep. 4, 1991. All of these disclosures are expressly incorporated herein by reference.

Referring now to the band application unit 14, it is appreciated that this unit functions to cut heat shrinkable band segments from a flattened tubular supply roll and to transfer the cut bands onto the top portion of containers being conveyed underneath the band application unit. Typically, commercially available band application units function to grasp each individual band as it is cut and to either hold the band in a position where it is stripped from the holding device by a passing container or to directly transfer the cut band onto the top portion of the container. In this regard, it is appreciated that some band application units have utilized one or more suction cups to grasp the individual bands as they are being cut and then to suspend the cut band such that a portion of the suspended band hangs downwardly in the path of the oncoming containers. When the container passes underneath, a top portion of the container will engage the drooping portion of the band and strip the band away from the suction cup in such a fashion that the band falls onto and is held about the top portion of the container.

Turning now to the conveyor assembly 12, it is seen that the conveyor is an endless conveyor disposed adjacent the band application unit 14 and functions to convey individual containers underneath the band application unit 14 where individual heat shrinkable cut bands are applied to the containers. Viewing conveyor assembly 12 in more detail, it is seen that the same includes a frame structure 16 that provides support for the conveyor assembly 12. Mounted on the frame structure 16 is a conveyor housing 17 which contains the movable parts of the conveyor assembly 12. A drive shaft 18 is rotatively journaled and supported by the conveyor housing 17. Fixed to opposite ends of the drive shaft 18 are a pair of drive sprockets 20, with each drive sprocket 20 including a series of teeth formed about the periphery of the sprocket 20. Rotatively journaled at the opposite end of the conveyor housing 17 is an idler shaft 22 that is also supported by the conveyor housing 17. Secured to opposite ends of the idler shaft 22 are a pair of idler sprockets 24. Trained around longitudinally aligned sprockets 20 and 24 are a pair of chains 26. As seen in the drawings, a single chain 26 is engaged with the teeth of an idler sprocket 24 and is also trained around and engaged with the teeth of an aligned drive sprocket 20.

Figure 3:
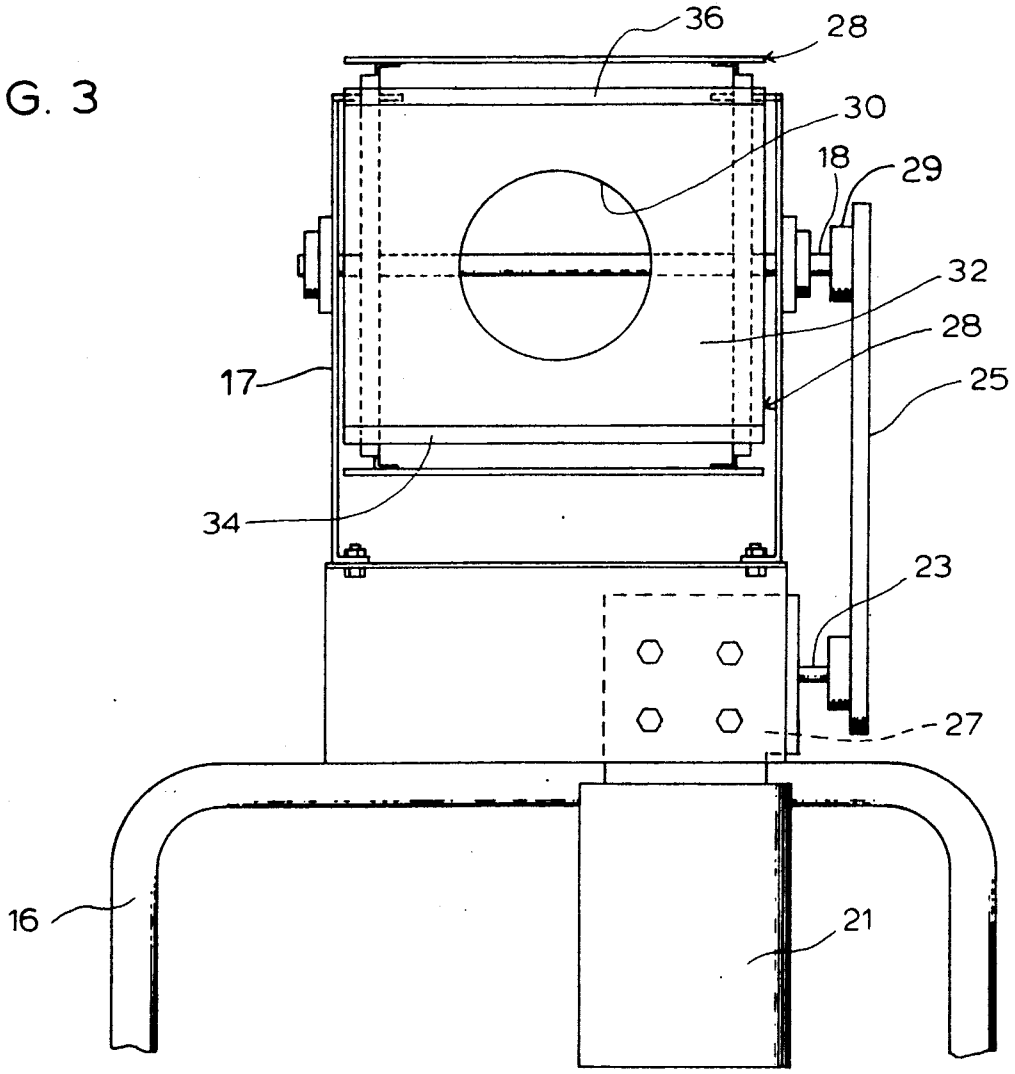
FIG. 3 is an end elevational view of the present invention.

To drive the conveyor assembly 12 there is provided an electric motor 21 mounted to the frame structure 16, as shown in FIG. 3. Electric motor 21 is connected to a right angle gear box 27 that includes an output shaft 23 that drives an endless belt 25. Belt 25 is in turn trained around a sheave or pulley 29 that is connected to the drive shaft 18 of the conveyor assembly 12.

Secured to the chain 26 is a series of band support plates indicated generally by the numeral 28. As seen in the drawings, the band support plates 28 are aligned and closely spaced, and are secured to the chains 26 such that as the chains 26 are turned clockwise, the plates 28 disposed along an upper run of the conveyor assembly 12, as viewed in FIG. 1, move left to right. The band support plates 28 disposed about the lower run of the conveyor assembly 12 move generally right to left.

Figure 2:
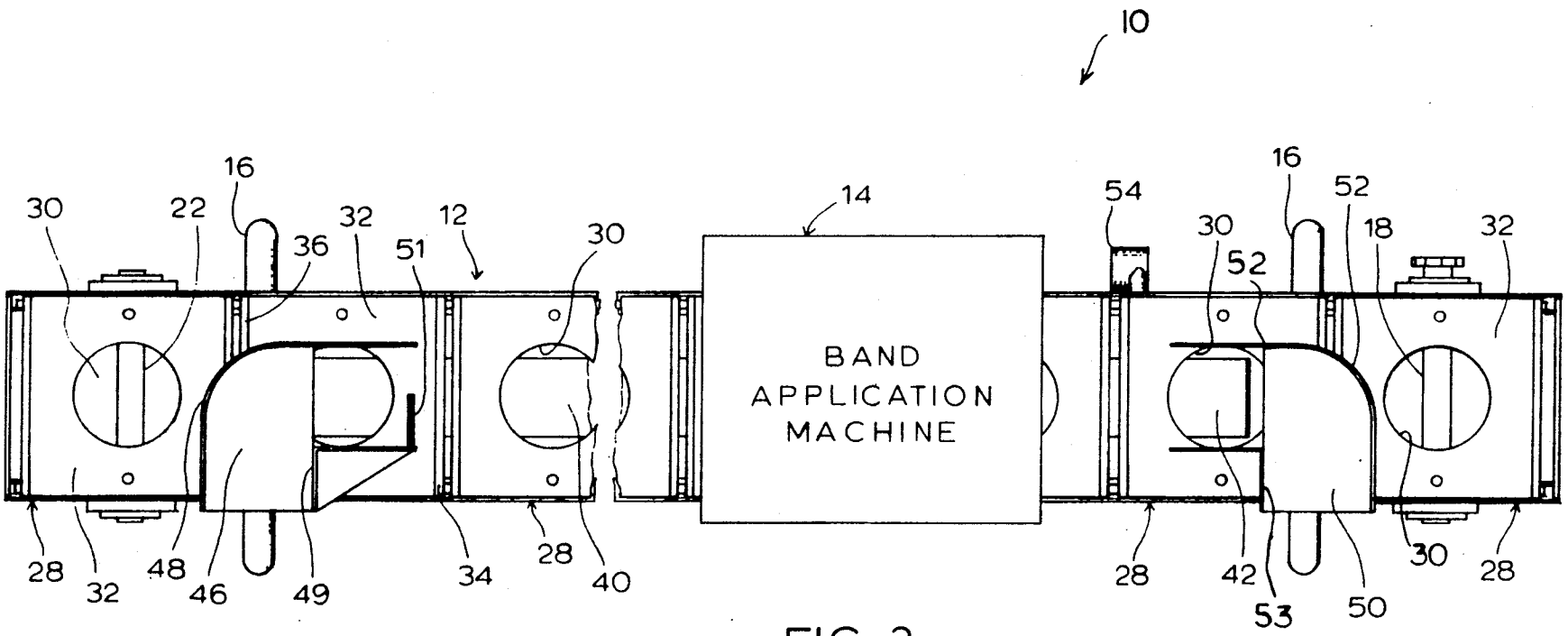
FIG. 2 is a top plan view of the present invention.

Viewing an individual band support plate 28, as shown in FIGS. 1 and 2, it is seen that the same includes a central container opening 30 and a surrounding band support plate deck 32. The support plate 28 includes a leading edge 34 which turns downwardly, and a trailing edge 36 which turns upwardly. The significance of the leading and trailing edges 34 and 36 will be addressed subsequently in this disclosure.

Figure 5:
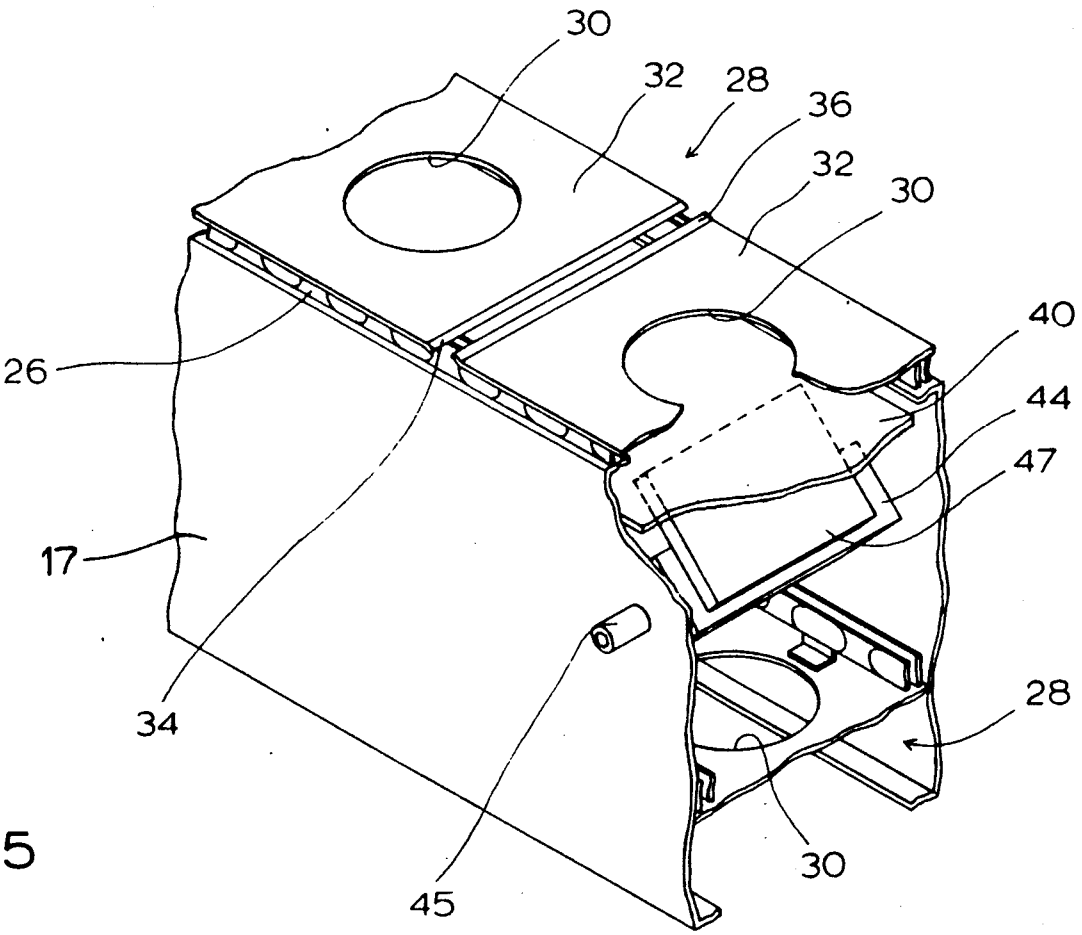
FIG. 5 is also a fragmentary perspective view of the present invention illustrating the support plate adjustment mechanism.

Supported by the frame structure 16 is a container support plate assembly indicated generally by the numeral 38 and disposed generally below the upper run of the conveyor assembly 12. Container support plate assembly 38 includes a pair of plates 40 and 42 that extend inwardly towards each other from opposite ends of the conveyor assembly 12 and which meet and overlap about a central portion of the conveyor assembly 12. Plates 40 and 42 are supported about the central portion of the conveyor assembly 12 by a series of longitudinally spaced bars 44. Attached to bars 44 are cam plates 47 which extend to and vertically support the container support plates 40 and 42. Selected bars 44 include an end section 45 extending through conveyor house 17. Selected bars 44 may be rotated to either raise or lower the overlying support plates 40 and 42. As shown in FIG. 5, when a selected bar 44 is rotated, the attached cam plate 47 will also be rotated, causing the support plate 40 or 42 to be raised or lowered with respect to the upper run of the conveyor assembly 12.

Figure 4:
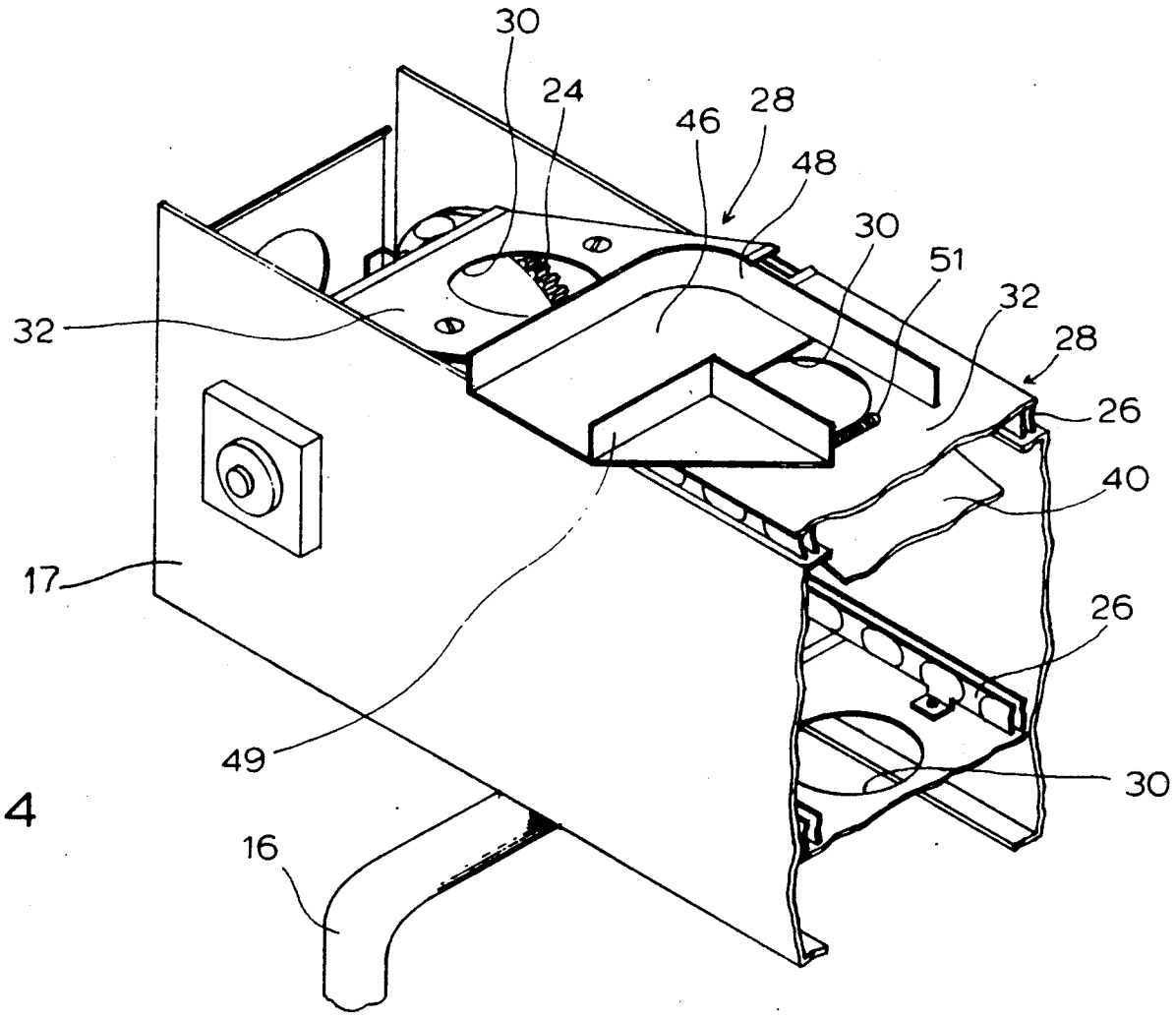
FIG. 4 is a fragmentary perspective view of the conveyor system of the present invention.

Viewing the container inlet end of the conveyor assembly 12, shown in FIG. 4, it is seen that the conveyor assembly 12 includes an extension plate 46 projecting horizontally over the upper run of the conveyor assembly 12. An outer side guide 48 and an inner side guide 49 extend along extension plate 46 to form guide rails associated with extension plate 46. The outer side guide 48 and inner side guide 49 have an entrance end located at the side of the conveyor assembly where containers are inserted onto the extension plate 46. The containers are pushed over the extension plate 46 and between guides 48 and 49 to an exit end. As the containers are pushed off the exit end of the extension plate 46, the containers drop into the container openings 30 of the band support plates 28.

To facilitate the insertion of a container C into container opening 30, there is provided a coil spring 51 attached to the inner side guide structure 49 and extending transversely across conveyor assembly 12. Coil spring 51 is a flexible member that lies in the path of containers being discharged onto the conveyor. The purpose of coil spring 51 is to prevent containers from being pushed downstream unless the containers have been inserted into a container opening 30. Coil spring 51 operates by preventing containers that do not have enough force to push by the coil spring 51 from being conveyed downstream. Containers placed on top of band support plate 28 and resting thereon do not have sufficient force to overcome coil spring 51 and are thus blocked from moving downstream. The containers are thus held in place allowing the band support plates 28 to pass underneath the blocked containers. As the support plates 28 pass below the containers, the containers drop into the container openings 30. Once the containers have been inserted into the container openings 30, the band support plates 28 provide sufficient horizontal force to push the containers past the flexible coil spring 51.

In like fashion, the discharge end of the conveyor assembly 12 (the right hand end as seen in FIG. 1) includes an extension plate 50 and container side guides 52 and 53. As will be appreciated from subsequent portions of this disclosure, the respective side guides 48, 49, 52, and 53 function to guide containers onto and off from the conveyor assembly 12.

Disposed downstream from the band application unit 14 is a spot-heat applicator 54 which functions to attach a heat shrinkable band to a respective container by spot heating the band as the same passes on the conveyor assembly 12. It should be appreciated that during a subsequent portion of the band application process the respective containers and bands are subjected to a final or full heat treatment process that would heat shrink the entire band such that it is securely and firmly held about the container.

As illustrated in FIGS. 6–11, the band conveyor and application system 10 performs a sequence of operations to apply tamper-evident bands to containers. First, respective containers C are fed from a supply conveyor onto the extension plate 46 that is disposed at the inlet end of the conveyor assembly 12. As containers C are inserted onto the extension plate 46, the containers C tend to push each other such that the containers slide along the edge of side container guide 48 to where they are positioned onto the band support plates 28 traveling on the upper run of the conveyor assembly 12.

Coil spring 51 extends from guide 48 into the pathway of a container C that has initially been pushed onto a band support plate 28 moving toward the band application unit 14. Coil spring 51 prevents a container C resting on top of the band support plate 28 from moving forward and causes the band support plate 28 to slide underneath the container C. As the band support plate 28 slides underneath container C, a container opening 30 in the band support plate 28 aligns with container C and gravity causes container C to drop into container opening 30 and come to rest against the underlying support plate 40.

The turned-down leading edge 34 and turned-up trailing edge 36 assist in the insertion of containers C into container opening 30 by ensuring that a container C pushed onto the conveyor assembly 12 cannot become trapped between adjacent band support plates 28. A container C pushed onto the conveyor assembly 12 may have to pass from one support plate 28 to an adjacent, upstream support plate 28 before being inserted into a container opening 30. The turned-up trailing edge 36 causes a container C sliding over a support plate 28 to be elevated so that the container C slides on top of the adjacent, upstream support plate 28 and then into the upstream support plate's container opening 30. The turned-down leading edge 34 of the upstream support plate 28 also ensures that a container C passing between adjacent band support plates 28 slides on top of the upstream plate 28 and then into the container opening 30 of the upstream plate 28. Without the turned-up trailing edge 36 of the band support plates 28, containers C could be caught in the transition area between adjacent band support plates 28 and not properly inserted into the container openings 30.

Figure 6:
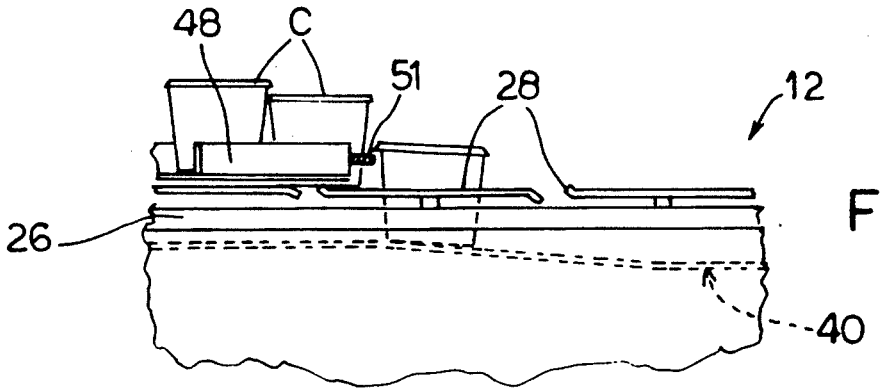
FIGS. 6–11 are a sequence of views showing how the conveyor system handles and conveys respective containers.
Figure 7:
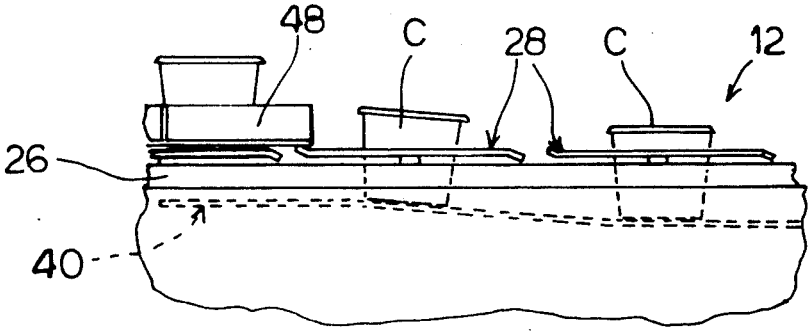
Figure 8:
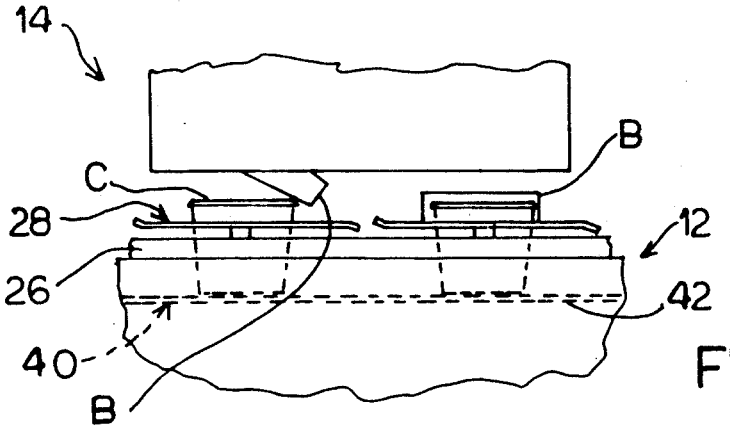
Figure 9:
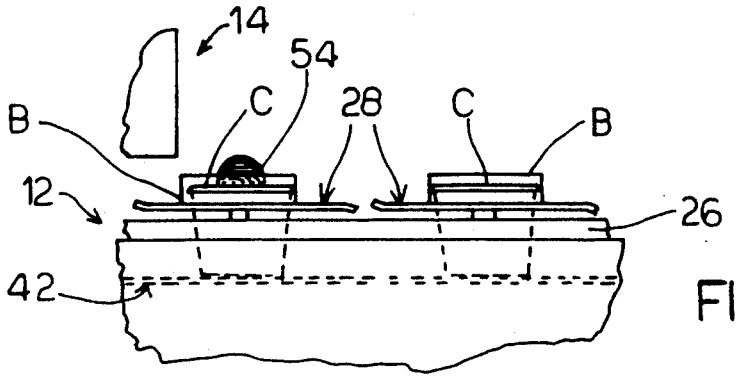

As seen in FIGS. 6–8, container support plate 40 initially extends horizontally from the container input section of the conveyor assembly 12 and then slopes downwardly to a lower horizontal section that extends beneath band application machine 14. As the containers move down the sloped section of the container support plate 40, the containers C drop further into the container openings 30 such that the band support plates 28 are positioned at the proper vertical position about containers C prior to reaching band application machine 14.

When containers C pass under the band support plate unit 14, individual cut bands B are transferred in conventional fashion to the container and onto band support plates 28. As seen in FIGS. 8–11, the individual cut bands B are supported about the band support plate deck 32 that extends completely around the container C. This effectively provides support for the band about a multiplicity of points around the container C. After a cut band B has been applied around the top portion of container C, the band B is maintained in a generally constant and set position about the container C by the band support plate 28 until the band B is spot-heated by the spot-heat applicator 54.

Figure 10:
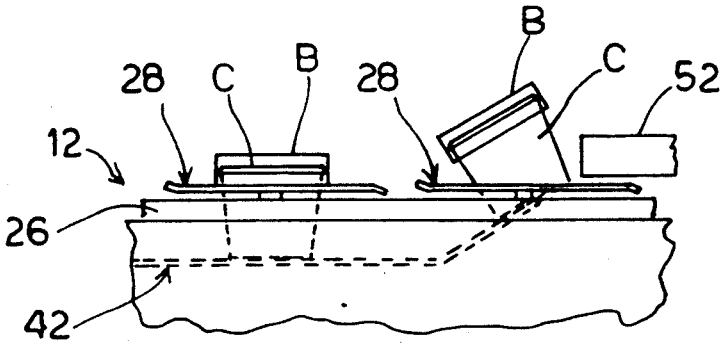
Figure 11:
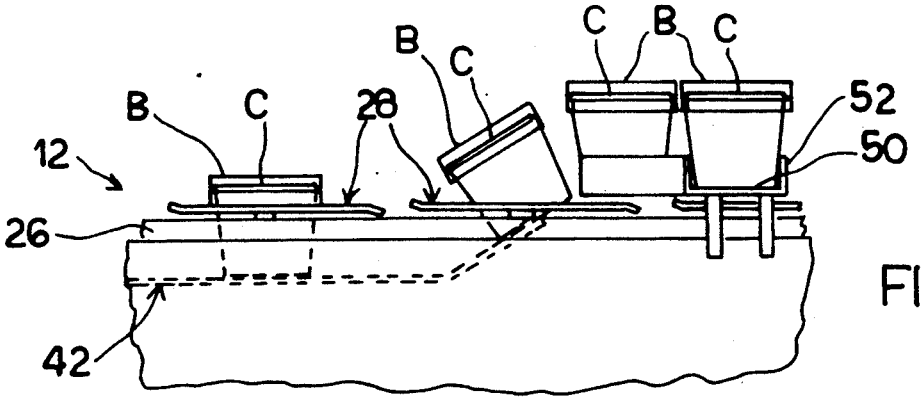

As shown in FIGS. 10 and 11, at a location beyond the spot-heat applicator 54 container support plate 42 slopes upward to the discharge end of the conveyor assembly 12 where containers C are removed from the conveyor assembly 12. As the container support plate 42 slopes upwardly and toward the exiting end of the conveyor assembly, the vertical distance between the band support plate 28 and the container support plate 42 decreases causing containers C to be pushed upwardly through container openings 30.

Therefore, as the container C moves up container support plate 42, it is appreciated that as the containers C reach the extreme elevated end of the container support plate 42, the containers C are urged vertically out of confinement with the container opening 30 of the band support plates 28. An extension plate 50 and a container guide 52 extends transversely across the exiting end and the containers C which have been upwardly pushed through container openings 30 slide onto extension plate 50 and engage container guide 52. As one container C after another emerges from the band support plates 28 at the exiting end of the conveyor assembly 12, containers C, as shown by FIG. 11, push against each other along the side container guide 52 so as to push the containers C from the conveyor assembly 12. Containers C passing from the extension plate 50 are directed onto a secondary conveyor assembly (not shown) which is used to transfer containers C from the conveyor and band application system 10.

The conveyor and application system 10 of the present invention has many advantages over other types of conveyor systems used for transferring containers being subjected to the application of heat-shrinkable bands. As noted beforehand, the elevation or height of the container support plate 38 can be adjusted such that the conveyor assembly 12 of the present invention can accommodate various sized containers.

In addition, the present invention supports the cut band continuously around the container such that the band is precisely positioned at a selected position around the container for heat shrinking treatment. The design of the present invention conveyor assembly 10 provides for relatively high speed application of tamper-evident bands to containers.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A conveyor system for use in conjunction with a machine that applies heat shrinkable bands to containers being conveyed by the conveyor system comprising:

(a) a conveyor assembly for receiving containers and transferring the containers to the band application machine where heat shrinkable bands are positioned around a top portion of the container, the conveyor assembly having an input section;

(b) band support plate means carried by and for movement with the conveyor assembly for substantially encompassing the respective containers and supporting a heat shrinkable band at multiple points around the container;

(c) means for inserting containers within the band support plate means before reaching the band application machine; and (d) means for varying the height of the respective containers extending above the band support plate means including means for vertically moving respective containers with respect to the band support plate means as the containers are advanced from the input section of the conveyor assembly towards the band application machine, and wherein prior to reaching the band application machine the respective containers assume a selected vertical position with respect to the band support plate means such that the respective containers project a preselected height above the band support plate means.

2. The conveyor system of claim 1 wherein the band support plate means forms a platform that substantially encircles the container to provide substantially continuous support to a tamper-evident band placed about a container.

3. The conveyor system of claim 1 further including means for vertically ejecting the containers from the band support plate means.

4. The conveyor system of claim 1 wherein the conveyor assembly includes an input end and a discharge end and wherein the associated machine for applying the heat shrinkable bands is disposed intermediately between the input and discharge ends of the conveyor system; and wherein the means for moving the containers with respect to the band support means includes means for vertically lowering the containers with respect to the band support means as the containers are moved from the input end of the conveyor system to the band application machine and for moving the respective containers upwardly with respect to the band support means as the respective containers are conveyed from the band application machine to the discharge end of the conveyor system.

5. The conveyor system of claim 4 wherein the means for moving the containers up and down with respect to the band support means as the containers are moved from the input end to the discharge end of the conveyor system includes the band support means working in conjunction with a stationary support plate that extends between the input and discharge ends of the conveyors system and below the band support means; and wherein the band support means forms a series of container openings that receive and engage respective containers and wherein the container openings enable the band support means to actually engage and push the respective containers along the lower stationary support plate, the stationary support plate extending up and down between the input end and discharge end of the conveyor system such that as the containers are pulled over the stationary support plate by the band support means the respective containers are moved up and down within the container openings due to the irregular height of the stationary support plate.

6. The conveyor system of claim 5 wherein the stationary support plate includes a first portion that is inclined downwardly between the input end of the conveyor system and the band application machine, and a second portion that is inclined upwardly between the band application machine and the discharge end of the conveyor system.

7. The conveyor system of claim 6 wherein the stationary support plate includes a third generally horizontal portion that extends between the two inclined portions.

8. A conveyor system for use in conjunction with a machine for applying tamper-evident bands to containers being conveyed by the conveyor system, the conveyor system comprising:

(a) a frame structure;

(b) a conveyor assembly mounted on the frame structure and including an endless conveyor with the conveyor assembly having upper and lower runs and a series of spaced apart container openings, each container opening having a band support plate for supporting said bands substantially surrounding the container opening, each container opening being larger in cross-section than an individual container to be conveyed by the conveyor system, and wherein individual containers are confineable within respective container openings such that once confined within a respective container opening the container is moveable vertically up and down within the container opening;

(c) wherein the surrounding band support plates actually engage and move the respective containers along the upper run of the conveyor assembly;

(d) means for inserting containers within the band support plate means; and (e) means for varying the height of the portion of the respective containers projecting above the band support plates relative to said band support plates as the containers are conveyed along the upper run by the band support plates and wherein the height varying means comprises a stationary container support plate extending along and below the upper run, and wherein the stationary container support plate assumes various heights along its run with respect to the upper run of the conveyor assembly such that as the respective containers are moved along the underlying stationary plate the irregular height of the stationary plate results in the containers moving vertically through the respective container openings as the containers are conveyed.

9. The conveyor system of claim 8 further including a container input section for positioning containers over the band support plates and including stop means for preventing containers placed on top of the band support plates from being conveyed downstream prior to the containers being inserted into the container openings.

10. The conveyor system of claim 9 wherein the stop means includes a flexible member that extends across the conveyor assembly to stop containers which are supported on top of the band support plates from being conveyed downstream until the container is inserted into the container opening of a band support plate, and to yield when the container is inserted into a container opening of a support plate allowing the container to pass the flexible member.

11. The conveyor system of claim 8 wherein each band support plate includes a leading edge that is turned down for facilitating insertion of the containers into the container openings of the band support plates moving on the conveyor assembly, wherein a container sliding on top of a downstream band support plate to an upstream band support plate will slide over the turned-down leading edge of the upstream band support plate and then into the container opening of the upstream band support plate.

12. The conveyor system of claim 8 wherein each band support plate includes a trailing edge that is turned up for facilitating insertion of the containers into the container openings of the band support plates moving on the conveyor assembly, wherein a container sliding on top of a downstream band support plate to an upstream band support plate will be elevated by the trailing edge of the downstream band support plate such that the container slides over the leading edge of the upstream band support plate and then into the container opening of the upstream band support plate.

13. The conveyor system of claim 8 wherein the band support plate forms a platform that substantially encircles the container opening to provide substantially continuous support to a band placed about the container.

14. The conveyor system of claim 8 wherein the container support plate includes:

(a) a container input section for receiving and supporting containers held within the container opening such that a top portion of the containers extend above the container openings along the input section;

(b) a band application section located downstream from the container input section and spaced vertically below the container input section, and wherein as the containers move from the input section to the band application section the containers move downwardly with respect to the band support plates such that the portion of each respective container extending above the band support plate progressively decreases as the containers advance from the input section to the band application section where bands are placed on the containers; and (c) a container discharge section located downstream from the band application section and spaced vertically above the band application section; and wherein as the containers move from the band application section to the container discharge section the containers move upwardly with respect to the band support plates such that the portion of each respective container extending above the band support plate progressively increases as the container advances from the band application section to the container discharge section where the containers are discharged.

15. The conveyor system of claim 8 further including means for vertically adjusting the height of the stationary container support plate.

16. A method of inputting containers onto a conveyor and applying a heat shrinkable band to the containers as they are conveyed on the conveyor, comprising the steps of:

(a) inputting respective containers onto an input section of the conveyor by inserting the respective containers into container openings formed by a band support plate;

(b) moving the containers generally horizontally from the input section towards a heat shrinkable band application point;

(c) also moving the containers vertically within the container openings relative to the band support plate as the containers are being moved and conveyed generally horizontally from the input section towards the band application point;

(d) vertically stationing each container with respect to the adjacent band support plate before the application of a heat shrinkable band such that each container extends a selected and fixed distance above the band support plate prior to a band being applied to the container; and (e) transferring a heat shrinkable band onto respective support plates and around said containers as they pass the band application point.

17. The method of claim 16 wherein the containers also move vertically within the container openings as the containers are conveyed downstream from the application point.

* * * * *